US006256469B1

(12) United States Patent
Taniyama et al.

(10) Patent No.: US 6,256,469 B1
(45) Date of Patent: Jul. 3, 2001

(54) TONER SUPPLY APPARATUS IN IMAGE FORMING SYSTEM

(75) Inventors: Yoshiharu Taniyama, Kawasaki; Noriyuki Umezawa; Shinichi Itoh, both of Yokohama, all of (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/506,918

(22) Filed: Feb. 18, 2000

(51) Int. Cl.[7] ..... G03G 15/08

(52) U.S. Cl. ..... 399/258; 399/12; 399/262

(58) Field of Search ..... 399/262, 258, 399/119, 120, 12, 27, 37, 88; 222/DIG. 1, 167, 325; 141/363, 383

(56) References Cited

U.S. PATENT DOCUMENTS

| | | | | |
|---|---|---|---|---|
| 4,740,808 | * | 4/1988 | Kasamura et al. | 399/12 |
| 4,963,939 | * | 10/1990 | Kurando et al. | 399/12 |
| 5,774,773 | * | 6/1998 | Otsuka et al. | 399/262 |
| 5,867,757 | * | 2/1999 | Okazaki et al. | 399/262 |
| 5,966,574 | * | 10/1999 | Ui et al. | 399/258 |
| 5,970,273 | * | 10/1999 | Zenk et al. | 399/12 |
| 6,032,013 | * | 2/2000 | Nizawa | 399/262 |

FOREIGN PATENT DOCUMENTS

| | | | |
|---|---|---|---|
| 6-035320 | * | 2/1994 | (JP) . |
| 9-090727 | * | 4/1997 | (JP) . |
| 9-211947 | * | 8/1997 | (JP) . |
| 10-20642 | | 1/1998 | (JP) . |

* cited by examiner

*Primary Examiner*—Sophia S. Chen
(74) *Attorney, Agent, or Firm*—Foley & Lardner

(57) ABSTRACT

A toner supply device includes a toner cartridge. The toner cartridge includes a cylindrical container having a spiral protruding portion therein, and a cap having a toner discharging hole. The toner supply device also includes a drive unit for supplying a toner from the toner discharging hole while gripping and rotating the cap of the toner cartridge. A positioning portion is formed on the outer peripheral surface of the base end side of the cylindrical container, and a recessed portion engaging the positioning portion is formed in an inlet holder. The drive unit includes a holder and a holder cover, which are disassembled vertically, a cup-shaped holder guide, rotatably provided in the holder and holder cover, for gripping the cap at a position, at which the holder guide is communicated with the toner discharging hole, a motor for applying torque to the holder guide, and a drive gear for transmitting torque of the motor to the holder guide.

31 Claims, 11 Drawing Sheets

TONER SUPPLY APPARATUS IN IMAGE FORMING SYSTEM

BACKGROUND OF THE INVENTION

The present invention relates generally to a toner supply device for use in an image forming system, such as a copying machine, a facsimile or a printer. More specifically, the invention relates to a toner supply device for supplying a toner while rotating an exchangeable cylindrical toner cartridge and for breaking local accumulation of the toner in the toner cartridge by rotating the toner cartridge in forward and reverse directions by a predetermined angle during exchange of the cartridge or in a desired situation.

In a typical image forming system, the surface of an electrified photosensitive material drum is electrified, and an image information to be copied is exposed to the surface of the drum to form a latent image. Then, a toner is absorbed into the photosensitive material to form a visible image. This visible image is transferred to the surface of a paper, and the toner is fixed on the surface of the paper by heat and pressure. Then, cleaning and de-electrification are carried out to cause a predetermined image information to be a printed information on the surface of the paper. In a developing process for forming the visible image, the toner, together with a carrier of a magnetic material, is used as a developer.

The carrier serving as a main component included in the developer is used for carrying the toner and producing frictional electrification. Since this carrier is electrified to be used for causing the toner to be absorbed into the photosensitive material drum and the surface of the paper, the carrier does not adhere to the surface of the paper and is not consumed, so that the amount of the carrier does not decrease. On the other hand, although the toner itself is not electrified, the toner is gradually consumed to be decreased when a printed matter is prepared after processes, such as transfer, fixing and cleaning. Therefore, the toner must be supplied as required with the use of the image forming system.

The way for supplying the toner is broadly divided into two methods. One of the methods is a method for providing a cartridge dedicated to the copying machine and for supplying a predetermined amount of toner, which is filled in a container, from a supply port of the cartridge when the residual quantity of the toner in the copying machine is short. According to this method, when the toner is supplied to the cartridge from a container, it is difficult for a usual user to skillfully fill the toner in the small-diameter supply port of the cartridge, if not for experts, so that there is the possibility that the toner spills to dirty user's cloths and/or hands. If the spilled toner is raked up to be put in the cartridge, there is also the possibility that impurities are mixed therein.

The other toner supply method is a method using an exchangeable cartridge. This method is an excellent supply method easy to be used, since the exchangeable cartridge is capable of supplying a toner, which is mixed at the best to cause the image forming system to display the best performance to prepare a copied matter, to the developing part of the image forming system without mixing impurities, and of preventing the user for supplying the toner from spilling the toner or the user's cloths and/or hands from being dirtied.

In order to supply a toner using a conventional toner supply device, an empty cartridge formed so as to have a predetermined shape and standard is detached from a cartridge attaching part of a copying machine, and an exchanged cartridge which has the same shape and standard as those of the empty cartridge and which is filled with a toner, is attached on the cartridge attaching part after being sufficiently shaken. Although there are various shapes and capacities of toner cartridges, there is a cylindrical toner cartridge as one of them. The cylindrical toner cartridge has the merit of being capable of utilizing the inner peripheral wall to efficiently supply a toner to a discharging hole. If the cylindrical cartridge is horizontally arranged, a spiral groove is formed in the inner wall surface of the cylindrical cartridge, or the cylindrical cartridge is rotated about the central axis thereof, so that the toner is guided toward the discharging hole.

However, according to such a conventional toner supply device, it is indicated that the user shall shake the cartridge well before exchange of the cartridge in order to prevent the toner from being locally biased in the cartridge. If the user fails to carry out such a shaking operation, there are some cases where the toner is biased locally in the cartridge. Although the cartridge is exchanged, there is a problem in that the supply of the toner is slow or a desired quantity of supplied toner can not be obtained after exchange of the cartridge.

In addition, according to the above described toner supply device of a type wherein the cylindrical cartridge is rotated, if the power supply of the copying machine is turned off when the cartridge is rotated, the toner discharging hole can not be stopped while facing upwards. Therefore, it is required to provide a mechanism for always detecting the position of the discharging hole when the power supply of the copying machine is turned off regardless of the stop of the copying machine for exchange of the toner cartridge, and for adjusting the stopped position so that the detected discharging hole always faces upwards. Such detecting means or position adjusting mechanism increase the producing costs of the copying machine, so that the user has useless economical loads.

SUMMARY OF INVENTION

It is therefore an object of the present invention to eliminate the aforementioned problems in the above described conventional system and to provide a toner supply device capable of stably supplying a toner immediately after an exchange of a cartridge when the user fails to carry out a shaking operation, and the device having a constitution in which a used cartridge can be exchanged with a toner discharging hole facing upwards even though a position of the toner discharging hole of the cartridge faces toward any direction when the power supply of the copying machine is turned off.

In order to accomplish the aforementioned and other objects, according to a basic concept of the present invention, a toner supply device includes: a toner cartridge including a spiral protruding portion spirally protruding from at least an inner peripheral surface thereof, a filling positioning portion provided in a peripheral surface thereof in the vicinity of a base end portion of closed both end portions, and a toner discharging hole formed in the periphery thereof in the vicinity of a tip end portion of the both end portions; a cartridge supporting portion, provided on a body, for horizontally supporting thereon the toner cartridge while allowing rotation of the toner cartridge; an inlet holder provided on one end of an inlet side of the cartridge supporting portion, the inlet holder including a body-side positioning portion, which engages the filling positioning portion so that the toner discharging hole always faces upwards when the toner cartridge is attached and detached, and a biasing member for continuing to bias the base end portion of the toner cartridge toward the tip end portion by a predetermined biasing force after the toner cartridge is attached; and a drive unit including a cup-shaped gripping portion for covering a peripheral surface of the one end including the toner discharging hole of the toner cartridge and for gripping the toner cartridge while a position of a toner supply hole corresponding to the toner discharging hole of the toner cartridge is coincident with the toner discharging hole so as to always face upwards when the toner cartridge is attached, a drive gear comprising a gear set including a gear provided on a bottom of the gripping portion and a gear meshing therewith, and rotation driving means for applying a torque to the gripping portion and the toner cartridge gripped by the gripping portion via the drive gear.

In the toner supply device according to the above basic concept, a toner supply device according to a first aspect may comprise the toner cartridge having the cylindrical container, which has the spiral protruding portion and the filling positioning portion and the diameter of which decreases via a stepped portion so as to form a small-diameter portion at a tip end thereof, the small-diameter portion having an end surface being open; and a cap which is mounted on a tip end portion of the cylindrical container to engage the small-diameter portion and which has the toner discharging hole in a peripheral surface thereof so that the relationship between the position of the filling positioning portion and the position of the toner discharging hole is constant.

In the toner supply device according to the first aspect, the toner cartridge may further comprise a cover member for shielding the toner discharging hole, the cover member being formed of a ring having a greater width than a diameter of the toner discharging hole formed in the peripheral surface of the cap, sand cover member being mounted so that the small-diameter portion of the cap is slidable in axial directions.

Furthermore, the toner supply device according to the first aspect, may apply a seal of an elastic member for enhancing a face contact with the cover member, on the periphery of the small-diameter portion of the cap at least at a position, at which the toner discharging hole is formed.

In the toner supply device according to the above constitution, a groove extending in axial directions may be formed in an outer peripheral surface of the small-diameter portion of the cap, and a protrusion extending in axial directions is formed in an inner peripheral surface of the cover member, the groove engaging the protrusion to inhibit rotation the cover member to allow only slide of the cover member.

In the toner supply device according to the first aspect, a positioning protruding portion for regulating rotational movement of the toner cartridge may be provided on a tip end surface of the cap.

In the toner supply device according to the first aspect, the filling positioning portion formed on the base end side peripheral surface of the cylindrical container may be formed of a protrusion protruding in a radial direction of a circular container.

In the toner supply device according to the basic concept, the cartridge supporting portion may comprise a plate member having one end to which the inlet holder is assembled, the other end to which the drive unit is attached, and a U-shape at a cross section thereof; and a roller which is rotatably attached to a shaft mounted in the insertion hole which is formed on the inlet holder. In the toner supply device according to the basic concept, the inlet holder may comprise an inserting port, into which the toner cartridge is inserted while playing therewith; a recessed portion serving as a body-side positioning portion, which engages the filling positioning portion provided on the base end side peripheral surface of the toner cartridge; and a biasing lever serving as the biasing member, the biasing lever 19 being biased by a spring for biasing the cylindrical container, which is inserted in a horizontal direction, toward a tip end portion from a base end portion.

In a toner supply device according to a second aspect, the drive unit may comprise a semicylindrical holder which is secured to the other end on the insertion side of the cartridge supporting portion and which has a chamber communicated with a hopper-like supply port for supplying a toner to a developing device arranged below the cartridge supporting portion; a holder cover which has a semicylindrical shape corresponding to the holder and which is put on the holder to be secured thereto; a holder guide which is rotatably housed in the chamber formed by the holder and the holder cover and which has a toner supply hole having the same diameter as that of the toner discharging hole of the toner cartridge, the holder guide rotating with the toner cartridge while the toner supply hole is coincident with the toner discharging hole; a disk which has a hole engaging a positioning protrusion formed on a tip end surface of the toner cartridge and which has a shaft having a D-shaped cross section engaging a D hole formed in an end surface of the holder guide, the toner cartridge being fixed to the holder guide by the disk; a motor serving as the rotating means housed in the chamber formed by the holder and the holder cover; and a drive gear part including a plurality of gears provided in the vicinity of the chamber, the drive gear part meshing with a gear secured to a tip end of the shaft of the disk, to transmit a rotation driving force of the motor to the holder guide, disk and toner cartridge, which are integrated, to rotate them.

In the toner supply device according to the second aspect, the drive unit may comprise a screw-like feeding part provided in the chamber, a gear which is mounted on an end portion of the feeding part and which meshes with the drive gear part mounted on an output shaft of the motor, and a carrier auger for carrying a toner, which is supplied into the chamber from the toner cartridge, to the hopper-like supply port.

In the toner supply device according to the second aspect, the disk may be housed while the shift of the disk in the direction of rotation with respect to the holder guide is regulated, and the D-shaped shaft engages the D hole formed in the bottom of the holder guide at the center thereof, the D-shaped shaft engaging a hole formed in a partition wall, which separates the chamber from a housing chamber for the holder guide, while playing therewith, the D-shaped shaft having a tip end, on which a gear of the drive gear part is mounted and which engages a spring while playing therewith, the D-shaped shaft rotatably engages a bearing provided in the inner surface of the chamber.

In the toner supply device according to the above constitution, the gear mounted on the D-shaped shaft of the disk may have a protrusion on a surface on the side of the holder guide at an eccentric position, the protrusion engaging a rotation preventing hole, which is formed in the vicinity of the D hole of the partition wall, by a biasing force of the spring to be positioned so that the toner supply hole and the discharging hole face upwards.

In the toner supply device according to the above constitution, the device may comprise a pulley, to which a driving force is transmitted via a belt, and a pinion gear integrated with the pulley are mounted on the output shaft of the motor, and the drive gear part includes a first gear meshing with the pinion gear, a second gear rotating coaxially with the first gear, a third gear meshing with the second gear to rotate the carrier auger and being coaxial with the carrier auger, and a fourth gear being coaxial the first and second gears to protrude into the chamber to mesh with the gear mounted on the D-shaped shaft of the disk.

In the toner supply device according to the second aspect, the device may have the holder, the holder cover, the holder guide, the disk, the motor, the drive gear part and the carrier auger, which are comprised in an integrally combined assembly.

In the toner supply device according to the basic concept, the toner supply device according to a third aspect may further comprise an information recording part, provided on the base end side outer peripheral surface of the cylindrical container of the toner cartridge, for recording a toner information including the color, component and quantity of a toner housed in the toner cartridge; and a detector, provided in the toner cartridge receiving portion, for reading the toner information from the information recording part from the outer peripheral surface of the toner cartridge.

In the toner supply device according to the third aspect, the information recording part is commonly used by a positioning portion, which protrudes from the base end side outer peripheral surface of the cylindrical container of the toner cartridge, so as to engage a recessed portion serving as the body-side positioning portion provided in the inserting port of the inlet holder.

In the toner supply device according to the above constitution, the circumferential length of the protrusion serving as the positioning portion may be divided into a plurality of parts to record information of the toner housed therein.

In the toner supply device according to the above constitution, a toner supply device may further includes a micro switch serving as the detector, provided in the toner cartridge receiving portion, for recording the toner information while following a protruding shape of the information recording portion commonly used for the positioning portion.

In the toner supply device according to the third aspect, the information recording part may comprise a seal-like information recording part, applied on the outer peripheral side of the cylindrical container of the toner cartridge, for indicating information by color coding.

In the toner supply device according to the above constitution, a toner supply device may further includes an optical sensor serving as the detector for reading information recorded by color cording in the seal-like information recording portion.

DESCRIPTION OF THE PREFERRED EMBODIMENT

Referring now to the accompanying drawings, the preferred embodiments of a toner supply device for use in an image forming system, according to the present invention, will be described in detail below. In the preferred embodiments described below, a copying machine is used as an example of an image forming system, and while the detailed structure thereof will be described, a toner supply device for use in the copying machine will be described as an example.

Figure 1:
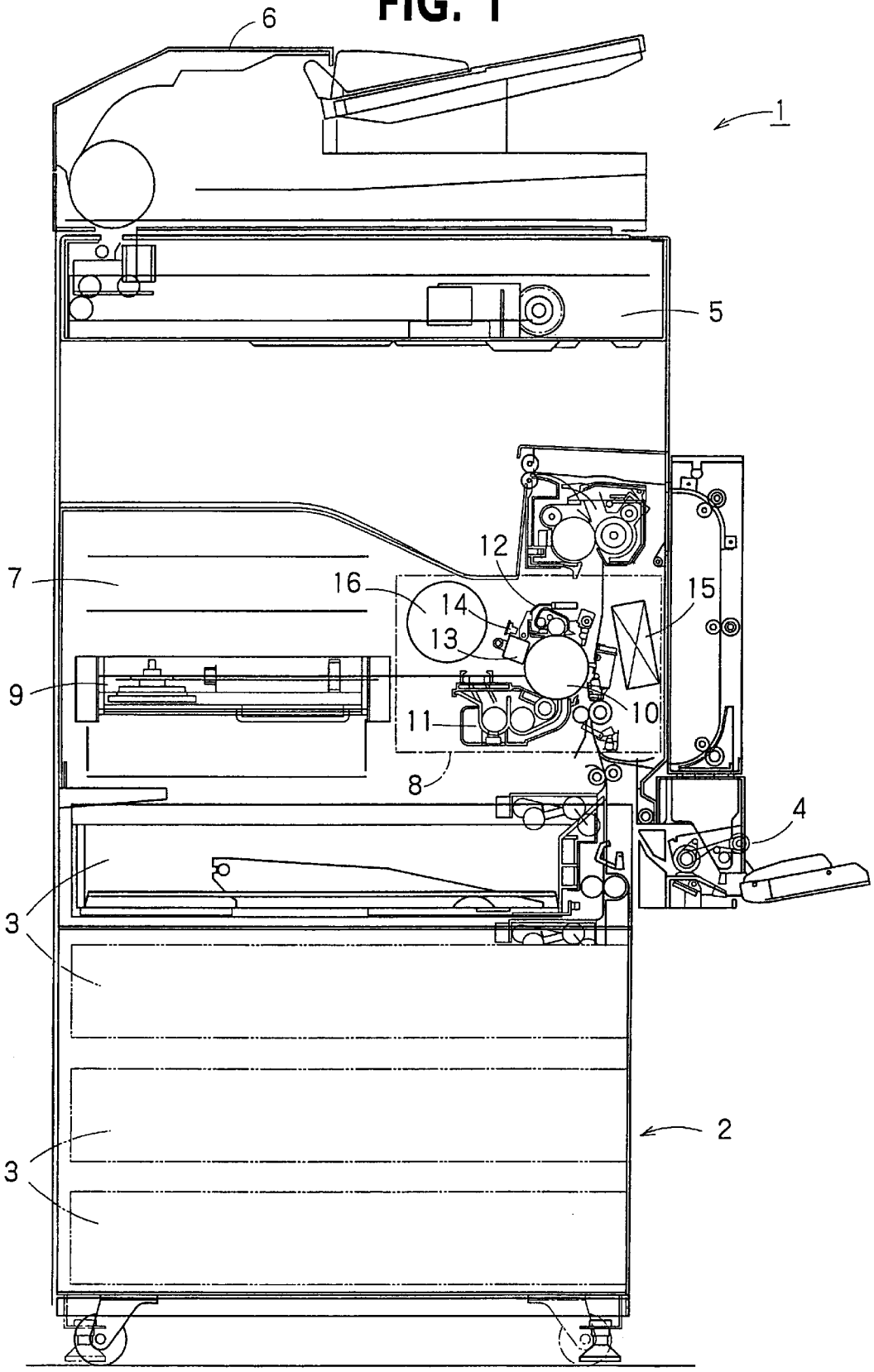
FIG. 1 is a sectional view showing the whole construction of a copying machine as an image forming system, to which a toner supply device according to the present invention is applied.

FIG. 1 is a sectional view showing the whole construction of a copying machine, in which a toner supply device according to the present invention is provided. In FIG. 1, a copying machine 1 has a paper feeding cassette device 2 for housing therein a large number of papers, in the lower portion of the body thereof. The copying machine 1 also has an LCF paper feeding device 3 for feeding a large number of papers having the same size, and a manual paper feeding device 4 capable of manually feeding various kinds of papers having various sizes.

The copying machine 1 includes: an image reading part 5, provided in the upper portion, for reading a manuscript; an automatic manuscript feeding device 6 for feeding the manuscript to the image reading part 5; an image storing part 7 for storing image data read by the image reading part 5; and an optical laser system 9 for deriving the stored image data to write an image to be printed, in an image forming part 8.

Figure 2:
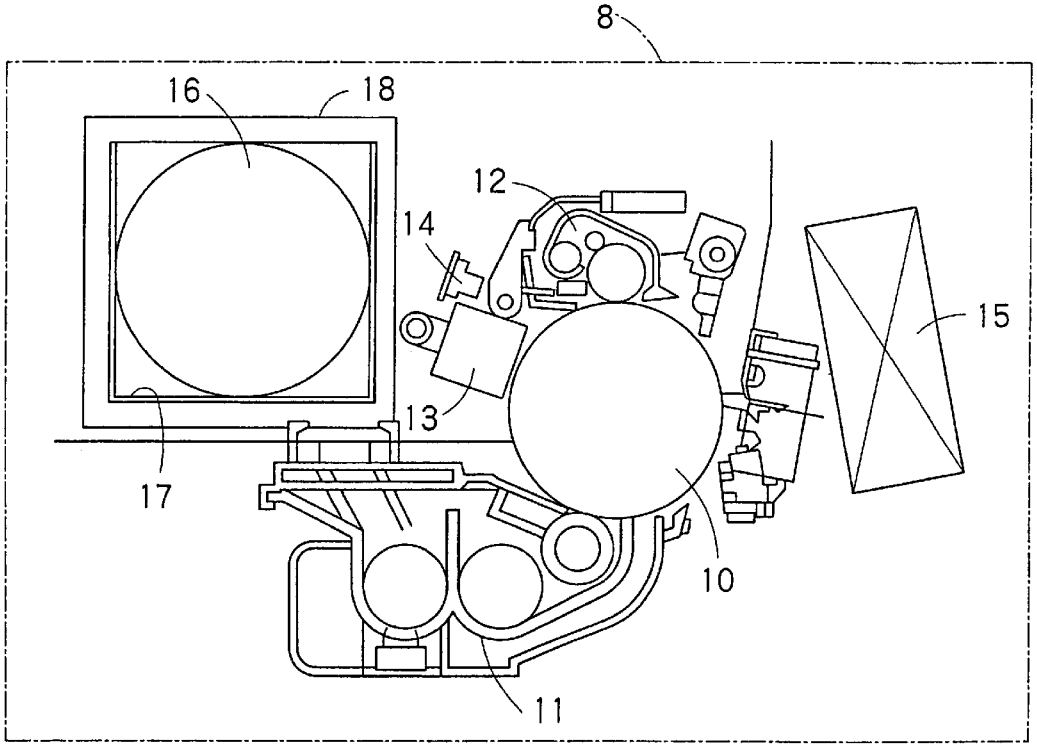
FIG. 2 is a schematic diagram showing a principal part of a toner supply device.

As shown in FIG. 2 in addition to FIG. 1, the image forming part 8 comprises a photosensitive material drum 10, a developing device 11, a cleaner 12, an electrification charger 13, a de-electrifying lamp 14, and a transfer/peeling charger 15. On the developing device 11, a toner cartridge 16 for supplying a toner, and a driving part 17 (not shown in FIGS. 1 and 2) for rotating the toner cartridge 16 are attached.

Figure 3:
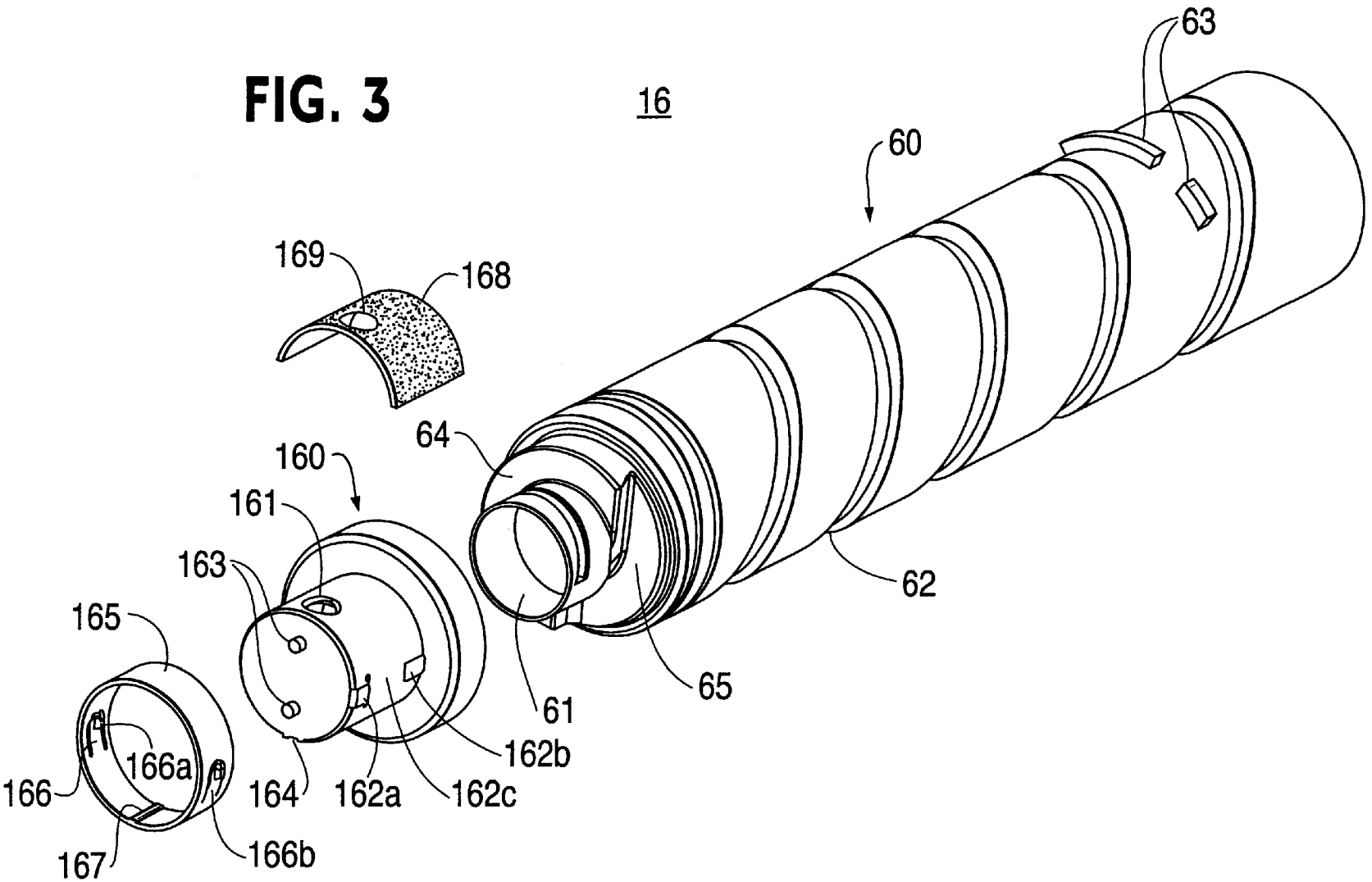
FIG. 3 is an exploded perspective view showing the details of a cylindrical container and cap constituting a toner cartridge.

Referring to FIG. 3, the detailed construction of the toner cartridge 16 will be described. In FIG. 3, the toner cartridge 16 comprises a cylindrical container 60 serving as a body, a cap 160 serving as a toner discharging part, and a discharging hole shielding cover 165.

The cylindrical container 60 has a cylindrical shape with a bottom. At least on the inner peripheral surface of the cylindrical container 60, there is formed a spiral protrusion (not shown) for gradually feeding a toner, which is previously filled, toward an opening portion 61 as the cylindrical container 60 rotates. In the first preferred embodiment shown in FIG. 3, the cylindrical container 60 is formed of a synthetic resin by the blow molding, so that a spiral groove 62 is formed in the outer peripheral surface of the cylindrical container 60 so as to correspond to the spiral protrusion for guide.

At a predetermined position spaced from the bottom of the cylindrical container 60, there are provided positioning portions 63 for positioning the outer periphery of the cylindrical container 60. In the first preferred embodiment shown in FIG. 3, two positioning portions 63 are formed by removing a part of a peripheral flange.

The opening portion 61 of the cartridge 16 is formed at the center of a stepped portion 64 and projects therefrom so as to have a predetermined diameter. A part of the stepped portion 64 is formed with a positioning cut-out portion 65 for integrating the container 60 with the cap 160 so as to establish a predetermined relationship between the positions of a discharging hole 161, which will be describe later, and the positioning portions 63 when the cap 160 is mounted on the cylindrical container 60.

The cap 160 has a shape having a stepped portion, which corresponds to the shape of the periphery of the opening portion 61 of the cylindrical container 60, as a whole. The cap 160 has the discharging hole 161 at an optional position on the peripheral wall thereof. The cap 160 is provided for supplying one dose of the toner when the cap 160 is rotated by a half rotation from the initial position to face downwards during the rotation of the toner cartridge 16 after the cap 160 is mounted on the cylindrical container 60. At positions shifted from the discharging hole 161 by 90 degrees in the peripheral wall surface, two engaging portions (protrusions) 162*a* and 162*b* for engaging a discharging hole shielding cover 165, which will be described later, are provided on each of both sides. Although only the engaging portions 162*a* and 162*b* on one side are shown in FIG. 3, other two engaging portions 162*a* and 162*b* are provided at positions shifted from the engaging portions 162*a* and 162*b* on the shown side by 180 degrees. As will be described in detail later, a groove 162*c* is formed between the two engaging portions 162*a* and 162*b*, and the cover 165 is designed to move in the groove 162*c* in axial directions to contact the engaging portions 162*a* and 162*b*.

On the tip flat surface of the cap 160, there are provided protruding portions 163 serving as positioning portions for engaging positioning recessed portions (not shown) formed in a flat surface of the inner wall of a holder guide of a drive unit 20, which will be described later, to inhibit the rotational shift between the holder guide and the toner cartridge 16. In this first preferred embodiment, the protruding portions 163 are formed by two bosses arranged in the radial directions corresponding to the position of the discharging hole 161. In addition, the protruding portions 163 serve to rotate the cylindrical container 60 while receiving the torque of a motor 26 (FIG. 4) which will be described later. On the opposite side of the discharging hole 161 in the radial direction in the peripheral wall of the cap 160, a guide groove 164 for guiding the axial movement of the cover 165 is formed so as to extend in axial directions.

The cover 165 for shielding and opening the discharging hole 161 has a ring shape having a predetermined diameter and a predetermined width which is greater than the diameter of the discharging hole 161. The cover 165 facing the engaging portions 162*a* and 162*b* and grooves 162*c* has protrusions for engaging the engaging portions 162*a* and 162*b*, and elastic spring portions 166 formed by forming U-shaped cut-outs in the periphery thereof. That is, the U-shaped cut-outs are formed in the cover 165 in circumferential directions thereof to form elastic tongue pieces 166 serving as cantilevers, and inner stoppers 166*a* and outer stoppers 166*b* are formed on the internal and external surfaces of the tongue pieces 166 so as to be movable in the grooves 162*c* of the cap 160 in axial directions to abut on the protrusions 162*a* and 162*b*.

Moreover, as described above, a protruding portion 167 protruding from the inner peripheral surface of the cover 165 to extend in axial directions thereof is provided so as to correspond to the guide groove 164 of the cap 160. The protruding portion 167 is positioned by the guide groove 164 so that the cover 165 is slidable along the peripheral surface of the cap 160.

Although the discharging hole 161 is open and closed by the sliding of the cover 165, there is a slight gap between the outer peripheral surface of the cap 160 and the inner peripheral surface of the cover 165. In order to prevent the toner from leaking from the gap while shielding the discharging hole 161, a seal 168 of an elastic material, such as felt or sponge, is applied on a portion surrounding the discharging hole 161. The seal 168 has a through hole 169 formed so as to face the discharging hole 161. The construction of the toner cartridge has been described above.

Figure 4:
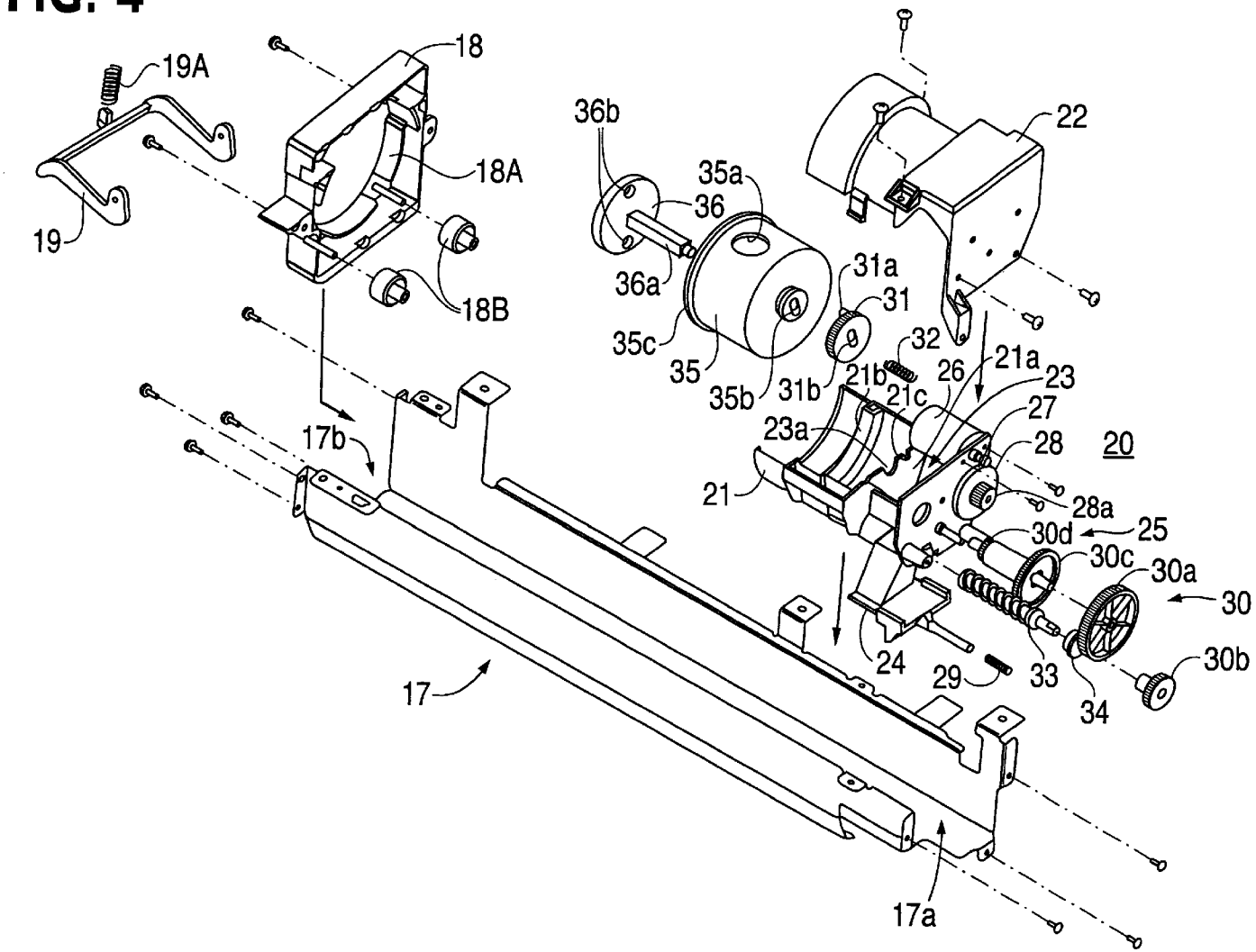
FIG. 4 is an exploded perspective view showing a driving unit of a toner supply device.

Referring to FIG. 4, the construction of the drive unit 20 for rotating the above described toner cartridge 16 will be described below.

Briefly, the torque of the motor 26 is transmitted to a disk (driving plate) 36 to rotate the toner cartridge 16 since the protruding portions 163 of the toner cartridge 16 are inserted into recessed grooves (driving holes) 36*b*, 36*b* formed in the disk 36. In addition, a carrier auger 33 is rotated by the motor 26 to move the toner from a chamber 23 to a hopper 24. The detailed construction of the drive unit 20 will be described below.

In FIG. 4, a cartridge receiving portion 17 is secured to the body of the copying machine 1, and is a substantially U-shaped receiving member of a metal or synthetic resin. The drive unit 20 is mounted on an end portion 17*a* of the U-shaped receiving portion 17 on the front side in the figure. A rectangular inlet guide 18 is secured to the other end portion 17*b* of the receiving portion 17 by means of a screw or the like. The inlet guide 18 has a guide hole 18A having a diameter capable of receiving the toner cartridge 16, and two rollers 18B along the periphery of the insertion opening 18A for rotatably supporting the toner cartridge 16.

Figure 5:
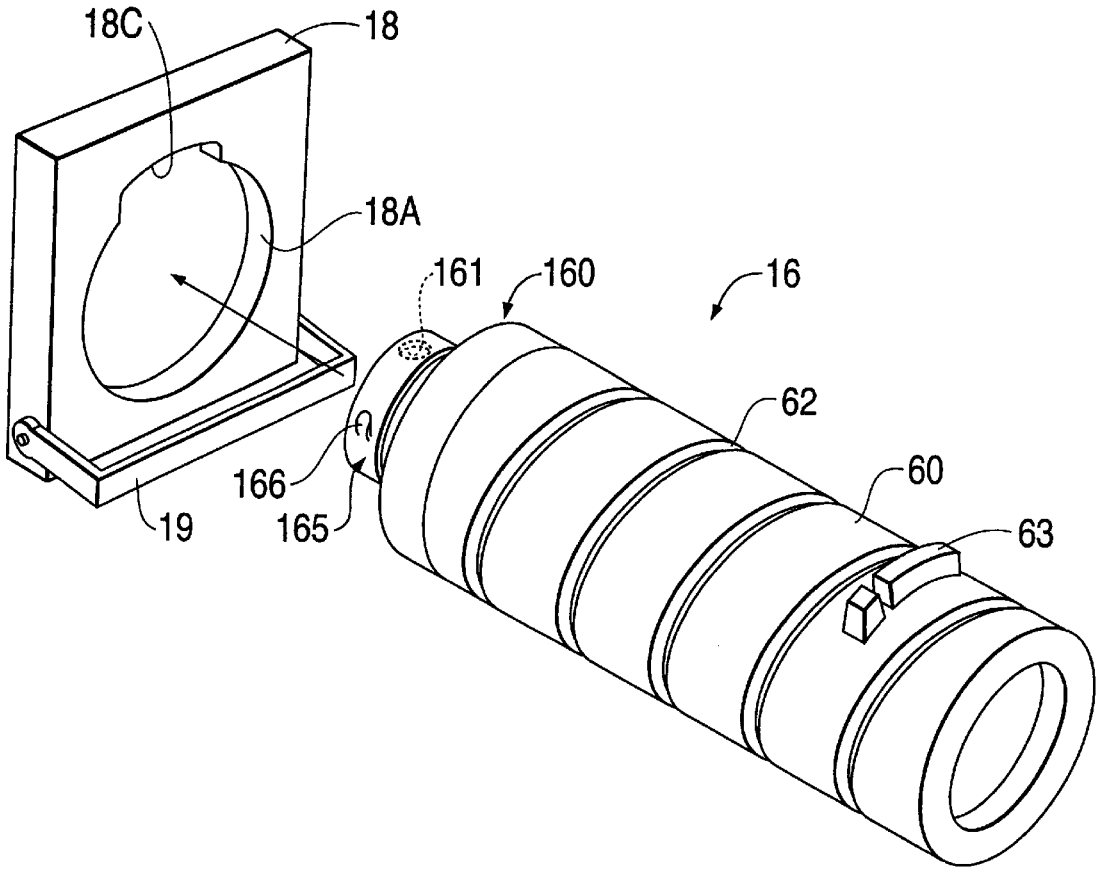
FIG. 5 is a perspective view showing a toner cartridge while being inserted into an inlet holder.

On the inlet guide 18, there is mounted a substantially C-shaped biasing lever 19 for biasing the bottom of the cylindrical container 60 toward the drive unit 20 after the toner cartridge 16 is attached. The biasing lever 19 biases the cylindrical container 60, which is inserted by a spring 19A in a horizontal direction, toward the drive unit 20 from the guide 18. FIG. 5 is a perspective view schematically showing the inlet holder 18, the biasing lever 19 and the toner cartridge 16 when the toner cartridge 16 is inserted into the inlet holder 18. As shown in this figure, on the upper side of the inner peripheral surface of the insertion opening 18A, there is formed a recessed portion 18C engaging the protruding positioning portion 63 of the cylindrical container 60, i.e., allowing the insertion and extraction of the toner cartridge 16.

As shown in FIG. 4, the drive unit 20 comprises: a substantially semicylindrical holder 21; a holder cover 22 integrated with the holder 21 for forming a cylinder which is open toward the inlet guide 18; a chamber 23 defined by the holder 21 and the holder cover 22; a hopper 24 for supplying a toner, which is filled in the chamber 23, to the developing device 11; and a drive mechanism 25 arranged in the vicinity of the chamber 23. The holder 21 and the holder cover 22 have a shape formed by dividing a cylinder. The holder 21 has a partition wall 21*a* defining the chamber 23, and an engaging partition wall 21*b* engaging a flange portion 35*c* of a holder guide 35 which will be described later. The partition wall 21*a* has a cut-out 21*c* which is associated with a facing partition wall (not shown) of the holder cover 22 for forming a hole.

The drive mechanism 25 comprises a motor 26 serving as a driving source, a belt 27, a pulley 28, drive gear sets 30, 31, a spring 32, a carrier auger 33 for promoting the movement of the toner from the chamber 23 to the hopper 24, a bush 34, a holder guide 35 and a disk 36. Furthermore, reference number 29 denotes a spring mounted on a pin of a cover of the hopper 24. The drive gear set 30 comprises: a large-diameter first gear 30*a*; a second gear 30*b* which meshes with the first gear 30*a* and which is mounted on the carrier auger 33 via the bush 34; a third gear 30*c* which meshes with a gear 28*a* integrated with the pulley 28 outside of the chamber 23; and a fourth gear 30*d* mounted on one end of a shaft, on the other end of which the third gear 30*c* is mounted. The fourth gear 30*d* is arranged in the chamber 23, and is designed to mesh with the gear set 31 fixed to the holder guide 35.

The holder guide 35 is a cup-shaped member having a diameter which is a size larger than the cylindrical portion at the tip of the cap 160 of the toner cartridge 16 shown in FIG. 3. The holder guide 35 has a supply hole 35*a* which is formed so as to face the discharging hole 161 of the cap 160. The central portion of the bottom of the holder guide 35 protrudes in the form of a boss, in which a D-shaped hole 35*b* is formed. The disk 36 has a shaft 36*d* having a D-shaped cross section, which passes through the D-shaped hole 35*b* of the holder guide 35, and holes or recessed portions 36*b* formed in the disk 36 on a line defining a diameter thereof at positions which are symmetrical with respect to the longitudinal central axis of the flat surface of the shaft 36*a*. Furthermore, reference number 35*c* denotes a flange portion for causing the holder guide 35 to engage the holder 21, and reference number 35*d* shown in FIG. 6 denotes an engaging protrusion engaging the cover 165 of the cap 160 to open the discharging hole 161.

The recessed portion 36*b* has a shape and size so as to engage the protruding portion 163 protruding from the tip end surface of the cap 160 of the toner cartridge 16. When the protruding portion 163 and the shaft 36*a* engage the recessed portion 36*b* and the D-shaped hole 35*b*, respectively, the toner cartridge 16 and the holder guide 35 are integrally rotated while at least the rotational shift therebetween is inhibited. In addition, the gear set 31 has a protrusion 31*a* engaging a hole which is formed by the cut-out 21*c* formed in the partition wall 21*a* of the holder 21, and the cut-out (not shown) of the holder guide 22 facing the cut-out 21*c*, and a D-shaped hole 31*b* having a shape corresponding to the D-shaped hole 35*b* of the holder guide 35. The tip portion of the shaft 36*a* of the disk 36 passes through the D-shaped holes 35*b* and 31*b* to engage the spring 32 while playing therewith, so that the shaft 36*a* rotatably engages a shaft receiving portion 23*a* formed in the inner wall of the chamber 23. The shaft receiving portion 23*a* is shown in the sectional view of FIG. 6 although it is not shown in the exploded perspective view of FIG. 4.

The respective parts with the above described constructions are previously assembled except for the toner cartridge 16. The drive unit 20 is assembled to be mounted on the one end side 17*a* of the cartridge receiving portion 17, and the inlet holder 18 having the biasing lever 19 is mounted on the other end portion 17*b*. The drive mechanism 25 of the drive unit 20 is mounted on the inside and outside of the chamber 23 separated by the partition wall 21*a* of the holder 21, to constitute the gear systems 30 and 31. The holder guide 35 is provided between the partition wall 21*a* of the holder 21 and the engaging partition wall 21*b* engaging the flange portion 35*c* of the holder guide 35 while the disk 36 of the holder guide 35 is mounted. While all of the parts are combined with the holder 21, the holder 21 is covered with the holder cover 22 to be fixed by the shown screw to be assembled, and thereafter, the assembly is fixed to the one end side 17*a* of the cartridge receiving portion 17.

If the peripheral wall of the cylindrical container 60 is nearly housed in the inlet holder 18 when the cylindrical container 60 is inserted from the other end portion 17*b* of the receiving portion 17, there is a problem in that it is difficult to insert and extract the cylindrical container 60. Therefore, the bottom of the cylindrical container 60 is provided with a handle (not shown) so that the user is easy to hold the cylindrical container 60. In this first preferred embodiment, the handle is formed with a mark for showing the direction of the toner discharging hole 161 of the cap 160. In addition, a concavoconvex non-slip portion is formed on the surface of the handle.

Referring to FIGS. 5 through 7C, the operations for attaching and detaching the toner cartridge 16 on and from the toner supply device with the above described construction will be described. First, in order to attach the toner cartridge 16 on the drive unit 20, after the toner cartridge 16 is horizontally arranged to be sufficiently shaken, the toner cartridge 16 is inserted into the guide hole 18A of the inlet holder 60 from the side of the cap 160 as shown in FIG. 5. At this time, if this insertion is carried out while the user grips the handle of the bottom of the cylindrical container 60 to turn the arrow mark upwards, the protruding positioning portion 63 of the cylindrical container 60 is coincident with the recessed portion 18C of the inlet holder 18. By thus inserting the toner cartridge 16, the discharging hole 161 of the cap 160 is inserted while remaining facing upwards. However, since the discharging hole 161 of the cap 160 is closed by the ring-shaped cover 165 at this time, the cover 165 can also prevent the toner from leaking.

Figure 6:
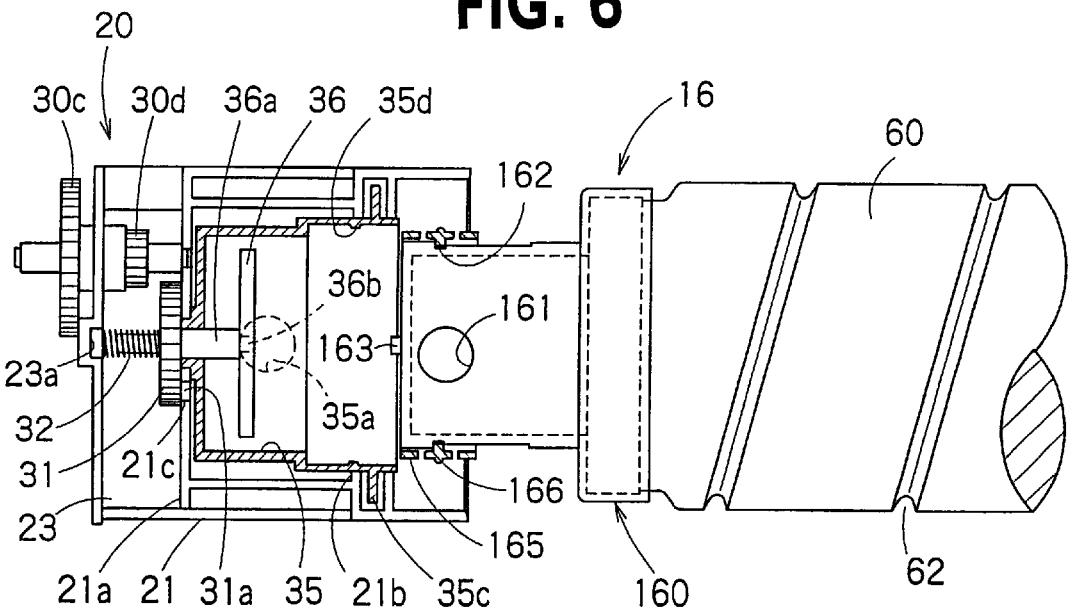
FIG. 6 is a sectional view showing a toner cartridge immediately being attached.

FIG. 6 is a plan view showing the state that the tip portion of the toner cartridge 16 engages the drive unit 20, which is viewed from the top of FIG. 5 to show the holder 21 and the toner cartridge 16 while the holder cover 22 is removed. This figure shows a cross section of only the holder guide 35 and the cover 165 of the cap 160. If the cartridge 16 is further inserted from the position shown in FIG. 6, the protruding portion 163 serving as the positioning portion engages the recessed portion 36*b* of the disk 36 to cause the tip end surface of the cap 160 to push the disk 36.

Slightly before this, the engaging protrusion 35*d* formed on the inner peripheral surface of the holder guide 35 engages the outer stopper 166*b* of the elastic tongue piece of the cover 165. Thus, the cover 165 slides while the protrusion 167 is guided by the guide groove 164 shown in FIG. 3, so that the discharging hole 161 is open. Thus, the discharging hole 161 is open in the holder guide 35, and the discharging hole 161 is coincident with the supply hole 35*a* of the holder guide immediately after the discharging hole 161 is open. In this state, the protrusion 31*a* of the gear set 31 engages the hole formed by the cut-out 21*c* of the holder 21 and the cut-out of the holder cover 22 facing the cut-out 21*c*. In FIG. 6, the cover 165 moves to the right with respect to the cap 160, so that the inner stopper 166*a* abuts on the engaging portion 162*b*. If the cartridge 16 is further thrust, the upper stopper 166*b* moves to the left in the figure to pass over the engaging protrusion 35*d* to a position shown in FIG. 7A.

Figure 7A:
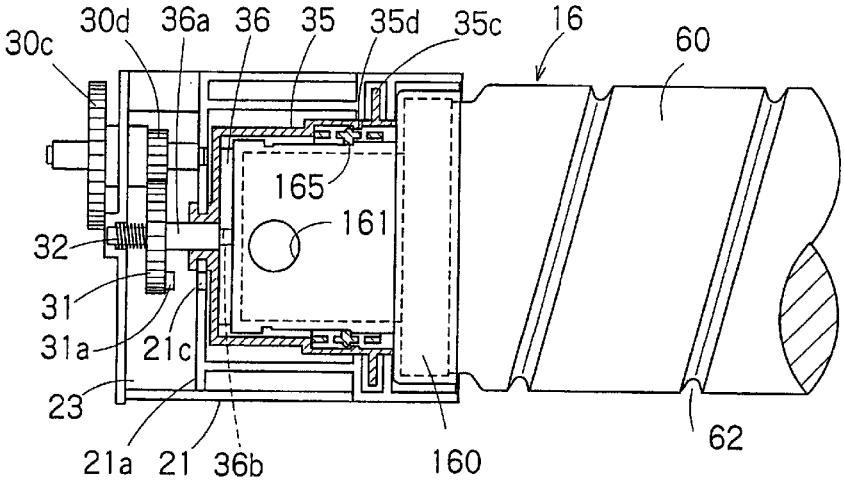
FIGS. 7A through 7C are sectional views showing the operation of detaching a toner cartridge.

Referring to FIG. 6 again, when the toner cartridge 16 is further thrust as described above, while the tip end surface of the cap 160 presses the disk 36 while the cylindrical portion 163 engages the recessed portion 36*b*, the shaft portion 36*a* contacts the shaft receiving portion 23*a* against the spring force of the spring 32 to be positioned. In this state, the gear set 31 mounted on the shaft portion 36*a* meshes with the fourth gear 30*d* of the gear set 30. This state is shown in FIG. 7A. By driving the motor 26 in this state, the torque of the motor is transmitted by the drive mechanism 26 comprising the gear sets 30 and 31 to rotate the cap 160 and the cylindrical container 60.

Figure 7B:
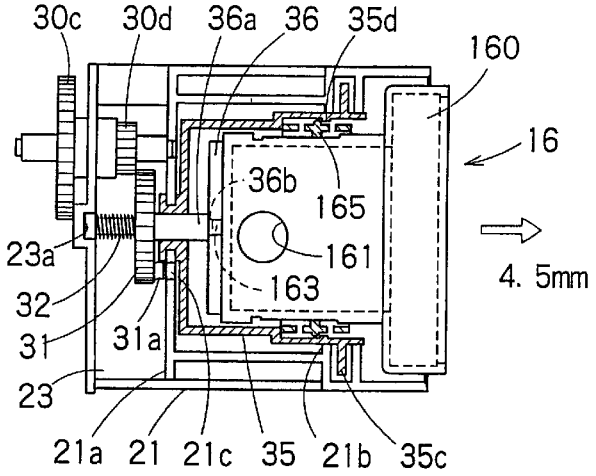
Figure 7C:
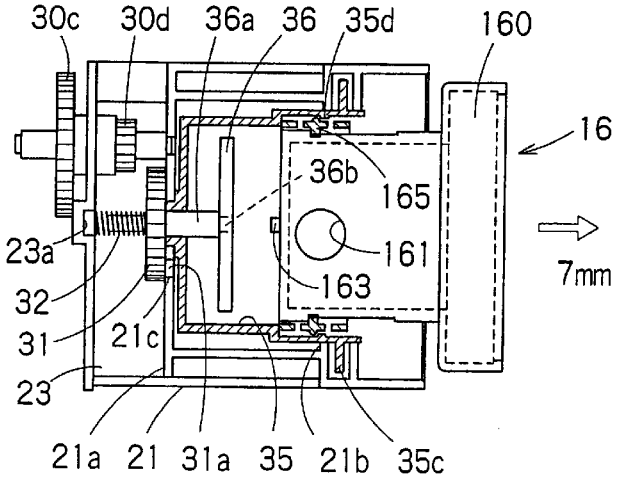

Referring to FIGS. 7A through 7C, the operation of detaching the toner cartridge by the drive unit 20 will be described below. In the conventional toner supply device, it is required to stop the rotation of the toner cartridge at a position, at which the discharging hole and the supply hole face upwards, so as to prevent the toner from leaking from the discharging hole of the cap and the supply hole of the holder guide. However, in the first preferred embodiment of a toner supply device according to the present invention, the rotation of the toner cartridge 16 can be stopped even if the discharging hole 161 is arranged at any rotational positions.

That is, although the toner cartridge 16 can be stopped even if the supply hole 35*a* of the holder guide 35 and the discharging hole 161 of the cap 160 are arranged at any positions, if the toner cartridge 16 is intended to be detached in this state, the toner cartridge 16 can not be detached since the recessed portion 18C of the inlet holder provided at the other end portion of the toner cartridge 16 is not coincident with the protruding positioning portion 63 of the container 60.

When the toner cartridge 16 is detached, the biasing lever 19 mounted on the inlet guide 18 is first open. At this time, the toner cartridge 16, the holder guide 35, the disk 36 and the gear set 31 are moved by the spring 32 by 4.5 mm in the direction shown by the arrow. By this movement by 4.5 mm, the gear 30D is disengaged from the gear set 31, so that the toner cartridge 16 can freely rotate.

Then, by freely rotating the toner cartridge 16 to cause the recessed portion 18C of the inlet guide 18 to be coincident with the protruding positioning portion 63 of the container 60, the toner cartridge 16 can be detached. At this time, since the toner cartridge 16 meshing with the disk 36 is rotated so that the protrusion 31*a* of the gear set 31 is coincident with the position of the engaging hole which is formed by the cut-out 21*c* of the partition wall 21*a* of the holder 21 and the cut-out of the holder cover 22 facing the cut-out 21*c*, the toner cartridge 16, the holder guide 35 and the gear set 31 are further moved by the spring 32 by 2.5 mm in the direction shown by the arrow (therefore, the total quantity of movement is 7 mm).

Thus, even if the toner cartridge 16 is detached, the holder guide 35 is fixed at the lower position so that the supply hole 35*a* faces upwards. Therefore, when a new toner cartridge 16 is inserted, the discharging hole 161 is always coincident with the supply hole 35*a* since the holder guide 35 is positioned.

In addition, when the drive mechanism is operated while the toner cartridge 16 is detached, the gear set 31 is disengaged from the gear 30*d*, so that the holder guide 35 does not rotate. Therefore, the supply hole 35*a* is not shifted, and the gears are not damaged.

Thus, when the toner cartridge 16 is attached and detached without providing the holder guide 35 with any detection mechanisms, the holder guide 35 can be always fixed at a predetermined position. Thus, even if the toner cartridge 16 is detached at any positions, when the toner cartridge 16 is attached again, if the toner cartridge 16 is attached while the protruding positioning portion 63 of the toner cartridge 16 is coincident with the recessed portion 18C of the inlet holder 18, the toner cartridge can be driven while the discharging hole 161 is coincident with the supply hole 35*a*.

In this state, the discharging hole 161 of the toner cartridge 16 is gradually being closed by the cover 165 shown by the two-dot chain line in FIG. 7B. If this is further extracted, the discharging hole 161 is completely closed as shown in FIG. 7C, so that the discharging hole 161 can remain being closed when the toner cartridge 161 is extracted. In this state, if the disk 36 is further moved by 2.5 mm by the biasing force of the spring 32, the toner cartridge 16 is moved by "4.5+2.5=7 mm" toward the inlet holder 18 as shown in FIG. 7C. In this state, since the bottom portion of the toner cartridge 16 is protruded by at least 7 mm from the inlet holder 18, if the user holds and extracts the bottom portion of the cylindrical container 60 of the toner cartridge 16, the used toner cartridge 16 can be extracted.

Figure 8:
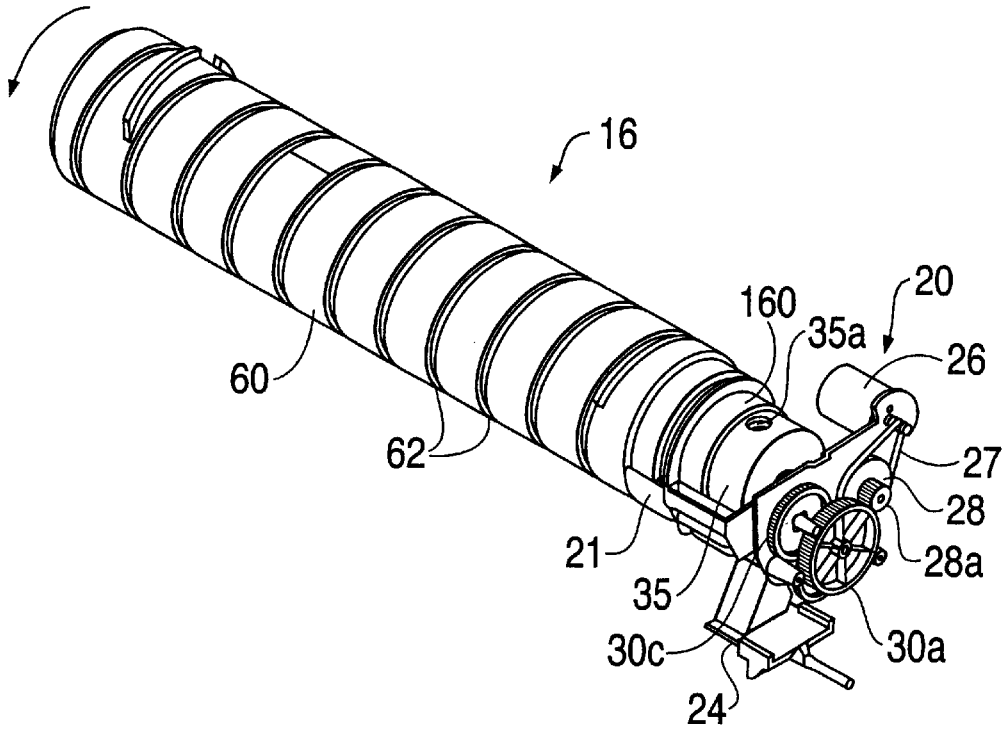
FIG. 8 is a perspective view showing the state that a toner cartridge is combined with a drive unit, together with a holder.
Figure 9:
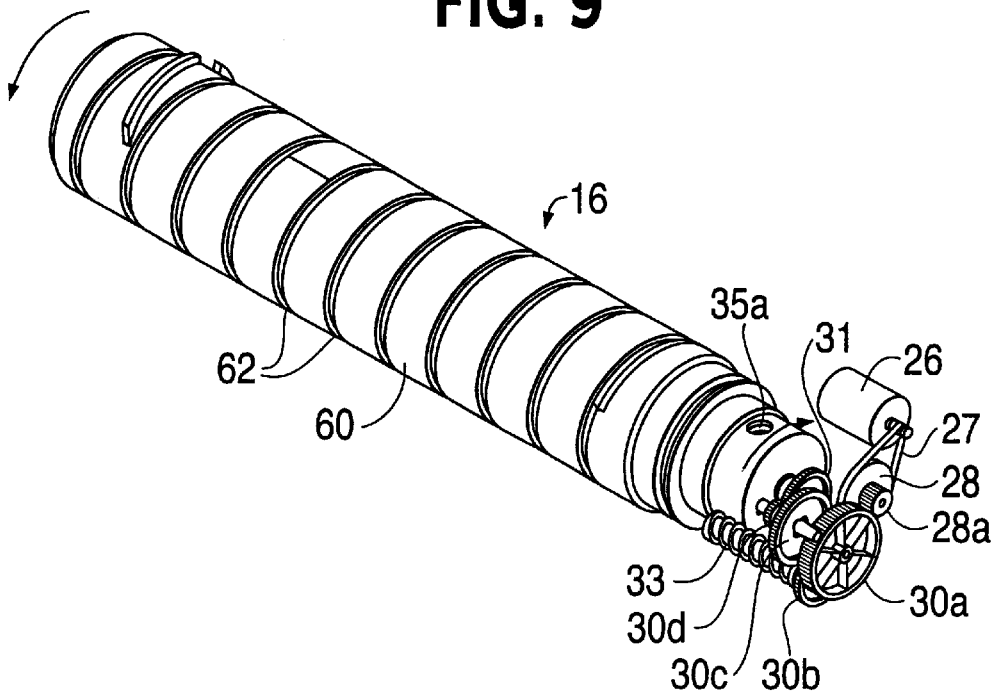
FIG. 9 is a perspective view showing the state that a toner cartridge is combined with a drive unit, wherein a holder is omitted.

FIGS. 8 and 9 are perspective views for explaining the operation of supplying a toner to a developing device 11 by means of the toner supply device with the above described construction. FIG. 8 shows a drive unit 20 and a toner cartridge 16, together with a holder 21. FIG. 9 is a perspective view showing the state that the holder 21 in FIG. 8 is omitted. In the toner supply device attached on the toner cartridge receiving part by the attaching operation described referring to FIGS. 3 through 6, a motor 26 serving as a drive part of the drive unit 20 is controlled by a control unit (not shown) as shown in FIGS. 8 and 9, so that the toner cartridge 16 receives torque from a drive mechanism 25, such as a gear, to rotate as shown by an arrow in the figure.

By this rotation, a spiral protruding portion formed in a cylindrical container 60 is sequentially carried toward a supply hole 35*a*. In a usual working state, the toner is carried by the forward rotation in the direction of the arrow. During exchange of the toner cartridge 16, the operation of breaking the toner biased on the bottom side can be carried out by alternately repeating the forward rotation in the direction of the arrow and the reverse rotation in the reverse direction of the arrow as described later.

The toner in the toner cartridge 16 is fed via a discharging hole 161 and a supply hole 35*a* by rotating the toner cartridge as required. The fed toner is temporarily stored in the carrier auger 33 of the holder 21, and then, supplied toward the developing device 11 from the supplying hopper part 24 of the holder 21 by means of the carrier auger 33. There is the variation in amount of the toner fed from the discharging hole of the toner cartridge 16 and the supply hole 35*a* per unit time. If the toner is supplied to the developing device 11 in this state, there are problems, such as over toner and "fogging". For that reason, the toner fed from the discharging hole 161 of the toner cartridge 16 is temporarily stored in the carrier auger 32, and then, carried by the carrier auger 32. Furthermore, a gear 30*b* mounted via a bush 34 meshes with a gear 30*a* to rotate the carrier auger 33 in synchronism with the rotation of the toner cartridge 16 to carry the toner.

Figure 10A:
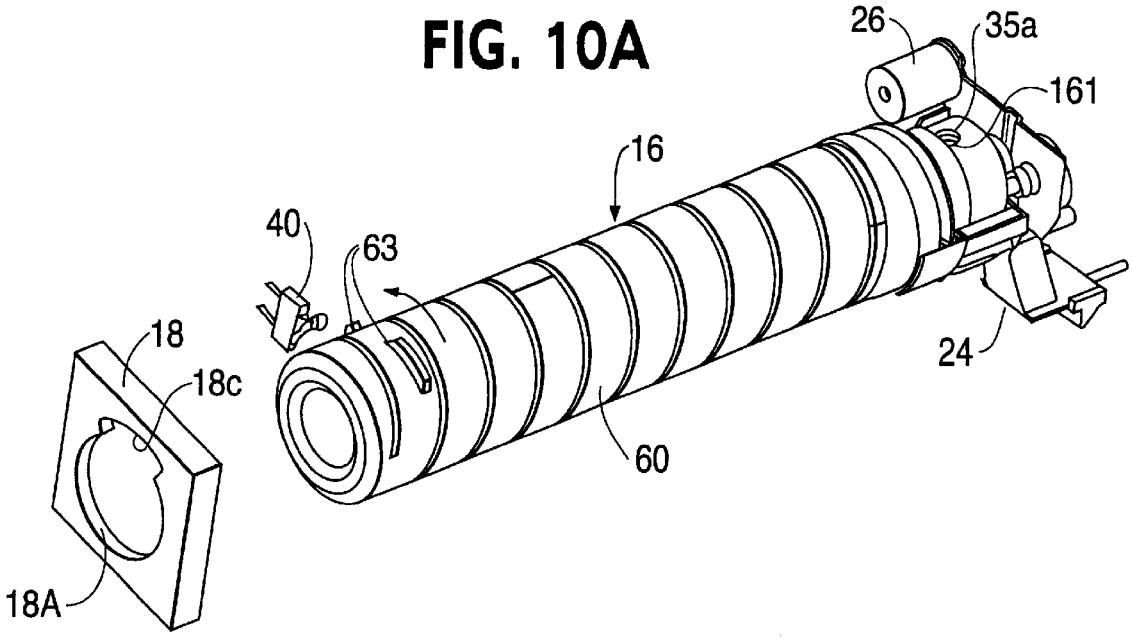
FIGS. 10A and 10B are perspective and back views showing a toner information recording part and a detector, which are provided on the outer peripheral side of a toner cartridge.
Figure 10B:
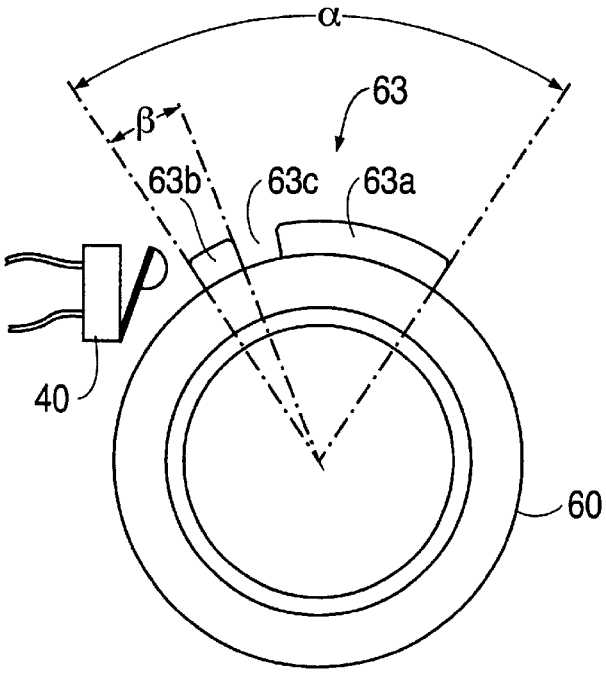

FIGS. 10A and 10B are schematic diagrams for explaining control when the toner cartridge 16 is attached. On the outer peripheral surface of the toner cartridge 16, a detecting protrusion is provided. In the shown preferred embodiment, a protruding positioning portion 63, which is formed on the peripheral wall of the cylindrical container 60 in the vicinity of the bottom thereof so as to correspond to a recessed portion 18C serving as a positioning portion when the toner cartridge 16 is inserted into a guide hole 18A of an inlet holder 18, also serves as a detecting protrusion. On the copying machine 1, a detector 40 of a micro switch or an optical sensor for reading information indicated by the protruding positioning portion 63 is mounted. The detector 40 has recorded the quantity, color, component and destination of the toner housed in the cylindrical container 60 of the toner cartridge 16, as information. By reading the information recorded on the outer peripheral surface by the detector 40 when the toner cartridge 16 is exchanged, the above described information relating to the exchanged and attached toner cartridge is fed to a control part (not shown) of the copying machine 1 to display toner information on a display part (not shown) on the basis of control of the control part.

The reading operation when the toner information is recorded on the outer peripheral surface of the cylindrical container 60 will be described below. As a first operation after the toner cartridge 16 is exchanged, the drive unit 20 rotates the toner cartridge 16 in the rotational direction during the supply of the toner, i.e., in the reverse direction (the direction of the arrow in FIG. 10A) of the arrow direction shown in FIG. 8, by two or more cycles to read the toner information from the detector 40 of a micro switch. If no protrusion is formed after the reading operation is carried out, it is determined that the toner cartridge is not a normal toner cartridge, a massage indicative thereof is displayed on the display part or the like.

For example, in the case of the protrusion shown in FIG. 10A, if the positioning portion 63 used for exchanging the cartridge is formed with a cut-out 63*c* to form two protrusions 63*a* and 63*b* as shown in FIG. 10B, and if the rate of an angle $\beta$ to an angle a has a predetermined meaning, the information relating to the toner can be added to the cartridge. For example, in the combination of the protrusions 63*a* and 63*b*, the mounting position angle $\alpha$ of the positioning portion 63 with respect to the toner cartridge 16 is fixed, and the destination can be changed to be domestic or specific country by changing only the width (positional angle $\beta$) of the protrusion 63*b*.

Figure 11A:
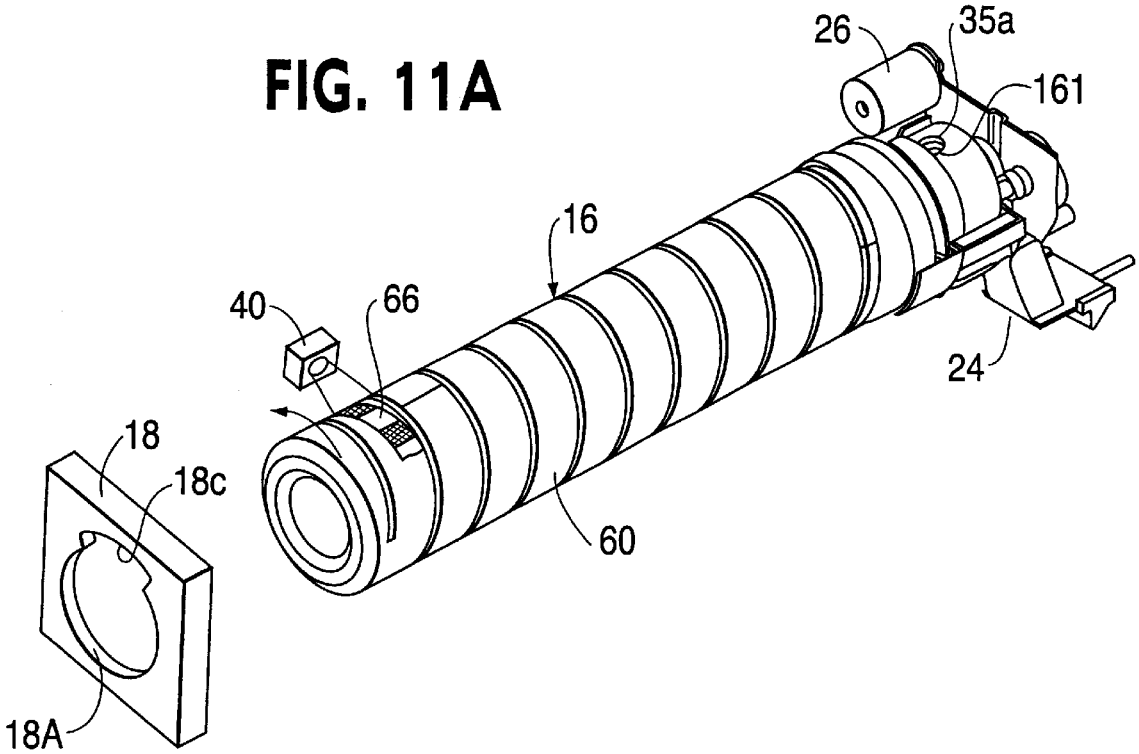
FIGS. 11A and 11B are perspective views showing different examples of a toner information recording part and a detector.
Figure 11B:
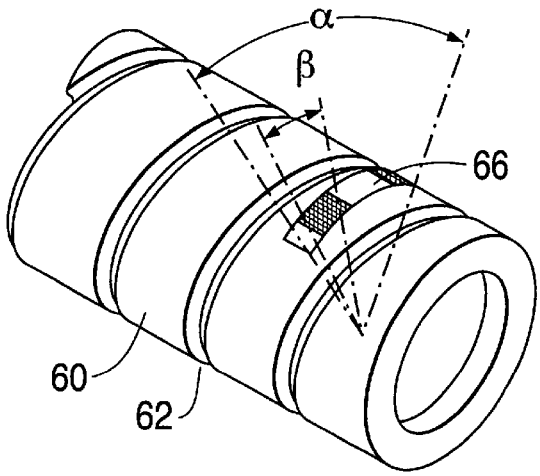

Furthermore, while the protruding portion of the positioning portion 63 engaging the recessed portion 18C of the inlet holder 18 has been used as the mark indicative of the toner information in the examples shown in FIGS. 10A and 10B, the present invention should not be limited thereto. A seal-like toner information part 66, on which a mark shown in FIG. 11B is printed, may be applied on the peripheral surface of the cylindrical container 60, and the information of the toner information part 66 may be detected by the detector 40.

After the reading operation, if it is confirmed that there are no errors of the quantity, component and destination of the toner, a toner supply operation is carried out. Before the toner supply operation, the toner supply device carried out a toner agitating operation. Since the toner cartridge 16 is usually stored so that the discharging hole faces upwards, the toner is tightly packed on the lower side of the cylindrical container 60. Therefore, notice is described on the manual for the exchange cartridge so that the cartridge shall be attached after the tightly packed state of particles is loosened from the state that the toner is compacted on the bottom side by sufficiently shaking the toner container before use.

However, the user who exchanges the toner cartridge often forgets to carry out the agitating operation. If the toner cartridge is exchanged without agitating the toner in the cartridge, even if the cylindrical container 60 is laid on its side, there are some cases where the toner on the upper side in the container is not supplied from the discharging hole 161 of the cap 160 toward the supply hole 35*a* of the holder guide 35, so that the toner remains gathering on the upper side in the cylindrical container 60.

According to the toner supply device of the present invention, even if the user forgets to carry out the agitating operation or does not sufficiently carry out the agitating operation, the drive unit 20 carries out the agitating operation immediately after the toner cartridge 16 is exchanged. Referring to FIGS. 12A through 12D, such an automatic agitating operation will be described. As shown by the broken line in FIG. 12A, the toner cartridge 16 during storage has a space on the upper side since the toner gathers on the lower side in the container 60. If only the toner cartridge 16 is laid on its side, the internal toner remains gathering on the bottom side in the cylindrical container 60 so as not to be easily broken toward the discharging hole 161. Therefore, if the user holds and shakes the toner cartridge 16 as shown by the outline arrow, the lump of the toner on the bottom side can be broken as shown in FIG. 12C.

Figure 12A:
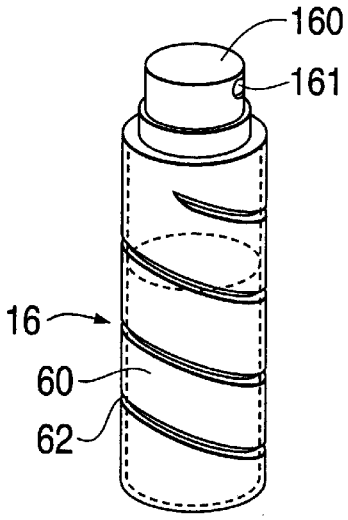
FIGS. 12A through 12D are perspective and back views for explaining the agitating operation of a toner cartridge.
Figure 12B:
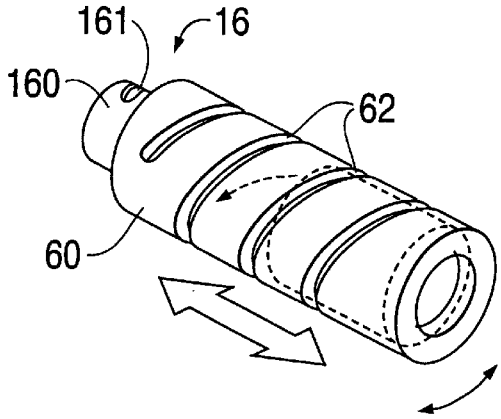
Figure 12C:
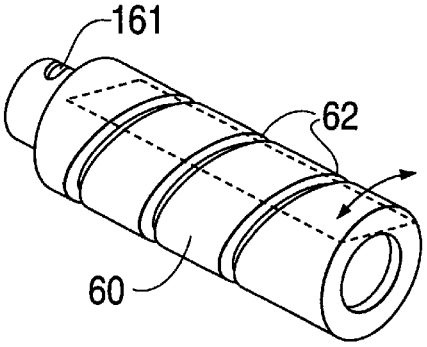

When the user did not sufficiently carry out or quite forgot such a shaking and agitating operation, the lump of the toner on the bottom side is automatically broken by rotating the drive unit 20 in forward and reverse directions bit by bit as shown by the arrow in FIG. 12B. After various vibration experiments are carried out by a machine to examine the broken state of the lump of the toner, it was found that the rotation of the drive unit 20 in forward and reverse directions bit by bit shown in FIG. 12B was most effective in the breaking of the toner.

Figure 12D:
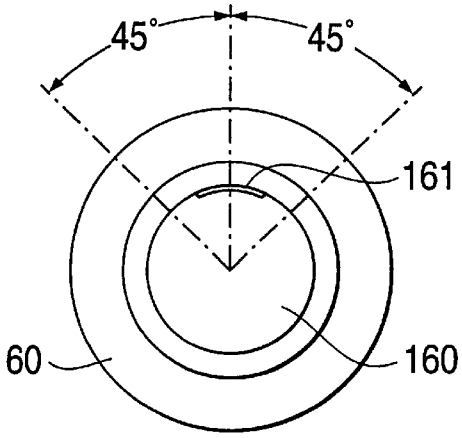

In order to break the lump of the toner, an angle exceeding an angle of repose indicative of the flowability of the toner is sufficiently effective. Therefore, as shown in FIG. 12D, a suitable angle exceeds the angle of repose with respect to a line passing through the center of the discharging hole 161 formed in the cap of the toner cartridge 16, and is less than an angle, at which the toner does not leak from the discharging hole 161 when the rotations in forward and reverse directions are carried out, so that the oscillating range of the cylindrical 60 is preferably set so that the center line of the discharging hole 161 is arranged in the range of 45 degrees in each of forward and reverse directions.

Furthermore, when the oscillating angular range is set to be 90 degrees by the drive unit 20, this can be easily controlled by using the detecting part 40 for detecting the angle a of the positioning part 63 shown in FIG. 10B by means of a micro switch. That is, if the angle a of FIG. 10B is about 70 degrees, after the detector 40 detects the outside of the protrusion 63*b* to allow a rotation by about 10 degrees, the rotation is reversed to detect the outer end of the protrusion 63*a*, and thereafter, a rotation by about 10 degrees is allowed to reverse the rotation again. Thus, the oscillating and agitating operation in an oscillating range of 90 degrees can be carried out by the drive unit 20.

What is claimed is:

1. A toner supply device comprising:

a toner cartridge including a spiral protruding portion spirally protruding from at least an inner peripheral surface thereof, a filling positioning portion provided in a peripheral surface thereof in the vicinity of a base end portion of closed both end portions, and a toner discharging hole formed in the periphery thereof in the vicinity of a tip end portion of the both end portions;

a cartridge supporting portion, provided on a body, for horizontally supporting thereon said toner cartridge while allowing rotation of said toner cartridge;

an inlet holder provided on one end of an insertion side of said cartridge supporting portion, said inlet holder including a body-side positioning portion, which engages said filling positioning portion so that said toner discharging hole always faces upwards when said toner cartridge is attached and detached, and a biasing member for continuing to bias said base end portion of said toner cartridge toward said tip end portion by a predetermined biasing force after said toner cartridge is attached; and a drive unit including a cup-shaped gripping portion for covering a peripheral surface of said one end including said toner discharging hole of said toner cartridge and for gripping said toner cartridge while a position of a toner supply hole corresponding to said toner discharging hole of said toner cartridge is coincident with said toner discharging hole so as to always face upwards when said toner cartridge is attached, a drive gear comprising a gear set including a gear provided on a bottom of said gripping portion and a gear meshing therewith, and rotation driving means for applying a torque to said gripping portion and said toner cartridge gripped by said gripping portion via said drive gear.

2. A toner supply device as set forth in claim 1, wherein said toner cartridge comprises: a cylindrical container, which has said spiral protruding portion and said filling positioning portion and the diameter of which decreases via a stepped portion so as to form a small-diameter portion at said tip end thereof, said small-diameter portion having an end surface being open; and a cap which is mounted on a tip end portion of said cylindrical container to engage said small-diameter portion and which has said toner discharging hole in a peripheral surface thereof so that the relationship between the position of said filling positioning portion and the position of said toner discharging hole is constant.

3. A toner supply device as set forth in claim 2, wherein said toner cartridge further comprises a cover member for shielding said toner discharging hole, said cover member being formed of a ring having a greater width than a diameter of said toner discharging hole formed in the peripheral surface of said cap, said cover member being mounted so that a small-diameter portion of said cap is slidable in axial directions.

4. A toner supply device as set forth in claim 3, wherein a seal of an elastic member for enhancing a face contact with said cover member is applied on the periphery of said small-diameter portion of said cap at least at a position, at which said toner discharging hole is formed.

5. A toner supply device as set forth in claim 3, wherein a groove extending in axial directions is formed in an outer peripheral surface of said small-diameter portion of said cap, and a protrusion extending in axial directions is formed in an inner peripheral surface of said cover member, said groove engaging said protrusion to inhibit rotation said cover member to allow only slide of said cover member.

6. A toner supply device as set forth in claim 2, wherein a positioning protruding portion for regulating rotational movement of said toner cartridge is provided on a tip end surface of said cap.

7. A toner supply device as set forth in claim 2, wherein said filling positioning portion formed on said base end side peripheral surface of said cylindrical container is formed of a protrusion protruding in a radial direction of a circular container.

8. A toner supply device as set forth in claim 2, wherein said inlet holder comprises: an inserting port, into which said toner cartridge is inserted while playing therewith; a recessed portion serving as said body-side positioning portion, which engages said filling positioning portion provided on the base end side peripheral surface of said toner cartridge; and a biasing lever serving as said biasing member, said biasing lever being biased by a spring for biasing said cylindrical container, which is inserted in a horizontal direction, toward said tip end portion from said base end portion.

9. A toner supply device as set forth in claim 2, which further comprises: an information recording part, provided on an outer peripheral surface of said base end side of said cylindrical container of said toner cartridge, for recording a toner information including the color, component and quantity of a toner housed in said toner cartridge; and a detector, provided in said toner cartridge holding portion, for reading said toner information from said information recording part from the outer peripheral surface of said toner cartridge.

10. A toner supply device as set forth in claim 9, wherein said information recording part is commonly used by a positioning portion, which protrudes from said outer peripheral surface of said base end side of said cylindrical container of said toner cartridge, so as to engage a recessed portion serving as said body-side positioning portion provided in an inserting port of said inlet holder.

11. A toner supply device as set forth in claim 10, wherein the circumferential length of said protrusion serving as said positioning portion is divided into a plurality of parts to record information of the toner housed therein.

12. A toner supply device as set forth in claim 10, which further comprises a micro switch serving as said detector, provided in said toner cartridge holding portion, for recording said toner information while following a protruding shape of said information recording portion commonly used for said positioning portion.

13. A toner supply part as set forth in claim 9, wherein said information recording part comprises a seal-like information recording part, applied on the outer peripheral side of said cylindrical container of said toner cartridge, for indicating information by color coding.

14. A toner supply device as set forth in claim 13, which further comprises an optical sensor serving as said detector for reading information recorded by color cording in said seal-like information recording part.

15. A toner supply device as set forth in claim 1, wherein said cartridge supporting portion comprises: a plate member having one end to which said inlet holder is assembled, the other end to which said drive unit is attached, and a U-shape at a cross section thereof; and a roller which is rotatably attached to a shaft mounted in an insertion hole which is formed on said inlet holder.

16. A toner supply device as set forth in claim 1, wherein said drive unit comprises:

a semicylindrical holder which is secured to the other end of the insertion side of said cartridge supporting portion and which has a chamber communicated with a hopper-like supply port for supplying a toner to a developing device arranged below said cartridge supporting portion;

a holder cover which has a semicylindrical shape corresponding to said holder and which is put on said holder to be secured thereto;

a holder guide which is rotatably housed in said chamber formed by said holder and said holder cover and which has a toner supply hole having the same diameter as that of said toner discharging hole of said toner cartridge, said holder guide rotating with said toner cartridge while said toner supply hole is coincident with said toner discharging hole;

a disk which has a hole engaging a positioning protrusion formed on a tip end surface of said toner cartridge and which has a shaft having a D-shaped cross section engaging a D hole formed in an end surface of said holder guide, said toner cartridge being fixed to said holder guide by said disk;

a motor serving as said rotation driving means housed in said chamber formed by said holder and said holder cover; and a drive gear part including a plurality of gears provided in the vicinity of said chamber, said drive gear part meshing with a gear secured to a tip end of said shaft of said disk, to transmit a rotation driving force of said motor to said holder guide, disk and toner cartridge, which are integrated, to rotate them.

17. A toner supply device as set forth in claim 16, wherein said drive unit comprises a screw-like feeding part provided in said chamber, a gear which is mounted on an end portion of said feeding part and which meshes with said drive gear part mounted on an output shaft of said motor, and a carrier auger for carrying a toner, which is supplied into said chamber from said toner cartridge, to said hopper-like supply port.

18. A toner supply device as set forth in claim 17, wherein said holder, said holder cover, said holder guide, said disk, said motor, said drive gear part and said carrier auger comprises an integrally combined assembly.

19. A toner supply device as set forth in claim 16, wherein said disk is housed while the shift of said disk in the direction of rotation with respect to said holder guide is regulated, and said D-shaped shaft engages said D hole formed in the bottom of said holder guide at the center thereof, said D-shaped shaft engaging a hole formed in a partition wall, which separates said chamber from a housing chamber for said holder guide, while playing therewith, said D-shaped shaft having a tip end, on which a gear of said drive gear part is mounted and which engages a spring while playing therewith, said D-shaped shaft rotatably engages a bearing provided in the inner surface of said chamber.

20. A toner supply device as set forth in claim 19, wherein said gear mounted on said D-shaped shaft of said disk has a protrusion on a surface on the side of said holder guide at an eccentric position, said protrusion engaging a rotation preventing hole, which is formed in the vicinity of said D hole of said partition wall, by a biasing force of said spring to be positioned so that said toner supply hole and said discharging hole face upwards.

21. A toner supply device as set forth in claim 20, wherein a pulley, to which a driving force is transmitted via a belt, and a pinion gear integrated with said pulley are mounted on an output shaft of said motor, and said drive gear part comprises a first gear meshing with said pinion gear, a second gear rotating coaxially with said first gear, a third gear meshing with said second gear to rotate said carrier auger and being coaxial with said carrier auger, and a fourth gear being coaxial said first and second gears to protrude into said chamber to mesh with said gear mounted on said D-shaped shaft of said disk.

22. A toner cartridge for use in a toner supply device for supplying a toner to an image forming system for forming an optional image including characters and pictures with said toner, said toner cartridge comprising:

a toner container having a cylindrical shape having an opening at a tip end thereof, said toner container being filled with a toner therein, said toner container having a spiral protruding portion formed in an inner peripheral surface thereof, and said toner container causing said toner, which is housed therein, toward said opening in an axial direction thereof when being rotated about an axis thereof;

a substantially cup-shaped cap engaging said opening and having a toner discharging hole for discharging said toner carried in said toner container, said cap being fixed to said toner container at a predetermined positional relationship when said cap is mounted on said toner container, so that said discharging hole always faces in a predetermined direction when said toner container is turned in a certain rotational direction with respect to said axis thereof; and a cylindrical cover engaging said cap so as to reciprocate in axial directions with respect to said cap between a first position on a tip end side and a second position on a base end side, said cylindrical cover closing said discharging hole to prevent said toner from being discharged at said first position, and opening said discharging hole to allow said toner to be discharged at said second position.

23. A toner cartridge as set forth in claim 22, wherein said cap having an engaging portion for receiving a force for rotating said toner cartridge about an axis thereof, from said image forming system when said toner cartridge is mounted on said image forming system.

24. A toner cartridge as set forth in claim 23, wherein said engaging portion comprises at least two protruding portions protruding from the top surface of said cap.

25. A toner cartridge as set forth in claim 24, wherein said discharging hole is formed in the outer peripheral surface of said cap at a position on a line which is drawn between said two protruding portions and which is substantially perpendicular to said axis.

26. A toner cartridge as set forth in claim 22, wherein said cap has protrusions on tip and base end sides along a bus line on an outer peripheral surface, and said cylindrical cover is movable in axial directions between said two protrusions to abut on said protrusions.

27. A toner cartridge as set forth in claim 26, wherein said two protrusions of said cap are formed at positions shifted from said discharging hole of said cap by substantially 90 degrees.

28. A toner cartridge as set forth in claim 26, wherein a groove and a protrusion, which extend in axial directions and which engage with each other, are formed in an outer peripheral surface of said cap and an inner peripheral surface of said cylindrical cover, respectively, said cylindrical cover being attached to and detached from said cap by sliding said groove and said protrusion while said groove engages said protrusion, so that the relationship between the relative rotations of said cap and said cylindrical cover about axes thereof is regulated to be a predetermined relationship.

29. A toner cartridge as set forth in claim 22, wherein said cover has at least two substantially U-shaped cut-outs formed in a peripheral portion thereof to form tongue pieces serving as elastic cantilevers, each of said tongue pieces having external and internal stoppers formed on the surface and reverse surface thereof in the vicinity of a tip end thereof, said internal stopper being slidable between said two protrusions of said cap to abut on said protrusions.

30. A toner cartridge as set forth in claim 22, wherein a seal for decreasing a gap between said cover and said cap is provided between said cover and said cap, said seal having a cut-out which overlaps said discharging hole to inhibit leakage of said toner when said discharging hole is closed by said cover.

31. A toner cartridge as set forth in claim 22, wherein a protruding positioning portion is formed on the outer peripheral surface of said toner container at a predetermined position, said discharging hole being turned in a predetermined direction by turning said toner cartridge about the axis thereof on the basis of said positioning portion, said toner cartridge being attachable and detachable in this state.

* * * * *